United States Patent [19]

Stratton

[11] 4,225,186

[45] Sep. 30, 1980

[54] HORIZONTAL MINING MACHINE AND METHOD OF SLOT MINING

[76] Inventor: John R. Stratton, 6735 Churchill Way, Dallas, Tex. 75230

[21] Appl. No.: 8,288

[22] Filed: Feb. 1, 1979

[51] Int. Cl.[2] ..... E21C 35/20; E21C 43/00

[52] U.S. Cl. ..... 299/18; 299/45; 299/75; 299/83; 173/43

[58] Field of Search ..... 299/18, 43, 45, 72, 299/75, 52; 173/43

[56] References Cited

U.S. PATENT DOCUMENTS

| | | | |
|---|---|---|---|
| 1,997,093 | 4/1935 | Wilson | 299/45 |
| 2,327,928 | 8/1943 | Osgood | 299/72 |
| 4,014,574 | 3/1977 | Todd | 299/18 X |
| 4,036,529 | 7/1977 | Hawthorne et al. | 299/19 |
| 4,059,309 | 11/1977 | Cleary | 299/18 |

FOREIGN PATENT DOCUMENTS

| | | | |
|---|---|---|---|
| 578453 | 10/1977 | U.S.S.R. | 299/52 |

*Primary Examiner*—Ernest R. Purser
*Attorney, Agent, or Firm*—Dennis T. Griggs

[57] ABSTRACT

Mining apparatus for removing near surface narrow seams of mineral deposits such as coal without removal of overburden is disclosed. The apparatus comprises a horizontal coal mining machine which is adapted for use in cooperation with large scraper type earth moving machines or bucket type cranes utilized in strip mining operations. The horizontal mine apparatus comprises generally a wide track service vehicle on which an internal combustion engine and hydraulic motors are disposed. An elongated cutting tool for removing a mineral deposit in a deep slot having a large depth to thickness ratio is supported on an elevator assembly which is pivotally mounted to the vehicle chassis. Linear actuators are coupled to the elevator assembly and cutting tool for adjusting the elevation, sweep and pitch of the cutter assembly to accommodate various changes in elevation and slope of the coal seam.

3 Claims, 6 Drawing Figures

HORIZONTAL MINING MACHINE AND METHOD OF SLOT MINING

BACKGROUND OF THE INVENTION

1. Field of the Invention

The present invention relates generally to apparatus for cutting deep slots in earth formations, and more particularly the invention relates to apparatus for cutting deep, slightly inclined slots to aid in the strip mining of shallow mineral deposits, particularly coal, without removal of overburden.

2. Description of the Prior Art

A strip mine is an open cut mine in which the overburden is removed from a bed of minerals such as coal before the mineral deposit is taken out. Large scale strip mining operations are carried out over many areas of the world in which an abundance of coal is deposited at a shallow depth below the surface of the earth. These coal deposits represent a potential source of relatively easily accessible and inexpensive fuel. The primary means of recovering these shallow coal deposits is by strip mining, that is, removing the overburden including top soil and foliage and then digging directly into the coal deposits. The removal of the overburden may be accomplished by various methods of excavation, but the basic operation consists of stripping the overburden to expose the mineral deposit and then depositing the stripped overburden in a mound in the area previously mined. The removal of the overburden, in strip mining operations, is generally performed by scraper type earth moving machines or bucket type cranes. Therefore, the major expense in strip mining is the excavation and removal of large volumes of overburden materials. After the minerals have been removed, an attempt is made to restore the natural contour of the land by replacing the overburden materials. However, the inversion of the overburden with respect to the top soil exposes pyrites and other metallic ores to rapid oxidation thereby weakening and leaching the soil and polluting adjoining waterways for many years.

Because of the expense and environmental degradation associated with removal of the overburden, strip mining operations are carried out over disjointed strip pit areas which coincide with concentrated coal deposits, thereby maximizing the ratio of minerals recovered to overburden removed while also minimizing the surface area disturbed. For such operations, narrow coal seams may interconnect the disjoined strip pits, or may lie contiguous with large coal deposits. For the reasons discussed above, it is neither economical nor desirable to remove the overburden from such narrow seams. Additionally, the operating expense for the rather large bucket machines or drag lines makes the cost of recovery for the narrow coal seams prohibitive.

Increasing energy demands require that all known energy sources be fully utilized. Therefore apparatus for carrying out strip mining operations are continuously being improved in order to economically and safely recover the vast coal deposits which lie at a shallow depth over many areas of the world. One such approach is to utilize the methods of "long wall mining", a technique which is limited to very deep coal beds where bed rock makes support relatively easy. Instead of removing the overburden, a narrow trench is dug alongside the coal seam and a long tunnel is dug horizontally along one end of the seam to form a passageway for setting up long wall machinery, including cutters, hydraulic rib supports and conveyors. As the cutters and conveyors work along the wall of the coal seam, new supports are erected next to the cutters and the old supports are removed thereby allowing the roof to cave in and the overburden to drop. Thus a considerable length of coal seam is mined but only a narrow trench need be refilled after the operation has been completed. Mining apparatus which is suitable for practicing the long wall mining technique is disclosed in U.S. Pat. No. 4,014,574. However, the long wall mining technique is still in the experimental stage and it is yet to be seen whether long wall mining can be cost effective for recovering shallow coal deposits.

SUMMARY OF THE INVENTION

The present invention concerns coal mining apparatus for recovering narrow seam, shallow coal deposits with minimal disturbance to the overburden. The mining machine of the invention is particularly well suited for use in combination with conventional scraper type earth moving machines or bucket type cranes in a conventional strip mining operation in which the overburden is removed from disjointed strip pits which are coincident with concentrated coal deposits. The principal purpose of the coal mining apparatus of the invention is to recover the mineral deposits which lie in narrow seams that interconnect disjointed strip pits or which lie contiguous to large coal deposits and which are not sufficiently concentrated to justify the expense associated with the removal and restoration of the overburden.

It is therefore a principal object of the present invention to provide mining apparatus for the removal of near surface mineral deposits which can be carried out with a minimum of disturbance to the surface of the earth, and which minimizes the inversion of the overburden and disturbance to topsoil.

Another object of the present invention is to provide an improved mining machine which can be used economically in combination with large scraper type earth moving machines or bucket type cranes for the removal of mineral deposits from narrow seams which may interconnect disjointed strip pits or which may lie contiguous with large coal deposits.

Because the narrow seams are generally planar and follow the contour of the overburden, and have relatively great lateral extent, it is an object of the present invention to provide an improved horizontal mining machine for recovering mineral deposits from such narrow sloping seams.

The foregoing and other objects are carried out according to the present invention by a mobile, wide track surface vehicle on which a cutter assembly is movably mounted and which projects laterally with respect to the machine for engaging a narrow seam, shallow mineral deposit. The cutter assembly includes an elongated guide bar and a cutting chain mounted for movement around the periphery of the guide bar to cut through and remove the mineral deposit as the surface vehicle moves along the face of the seam. The cutter assembly is supported by an elevator assembly which includes a guide track mounted on the vehicle chassis for pivotal movement about a horizontal axis extending transversely with respect to the direction of travel of the vehicle. The guide bar is supported on an elevator block which is engaged for linear reciprocal movement along the track. A linear actuator is coupled intermediate the guide track and the chassis for angularly displacing the guide track about its pivotal axis. Another linear actuator is coupled intermediate the guide track and the elevator block for adjusting the working elevation of the cutter assembly. A third linear actuator is coupled intermediate the chassis and the cutter bar for adjusting the sweep of the cutter assembly. By controlling the extension and retraction of the linear actuators, the elevation, pitch, sweep and force of cutting engagement of the cutter assembly can be accurately controlled in order to follow the various changes in elevation, slope and horizontal range of the mineral deposit.

Recovery of metal deposits from the shallow seams adjoining a strip mining operation is carried out after the primary harvest by large bucket cranes or scrapers has been completed, but before overburden reclamation procedures commence. Because of its relatively small size, the capital expenditure associated with its operation is correspondingly small so that it may harvest coal from narrow seam deposits on a cost competitive basis. Furthermore, because of the long reach of its elongated cutter bar, it is not necessary to remove the overburden lying above the narrow seam shallow deposits. Also because of its small size, the horizontal coal mining machine of the present invention can work in the existing opening formed by the large bucket scrapers without further excavation. Thus the coal mining machine of the present invention maximizes the recovery of mineral deposits in strip mining operations while minimizing the direct cost of the mineral recovery operation and the indirect cost associated with restoring the overburden.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DESCRIPTION OF THE PREFERRED EMBODIMENT

Figure 1:
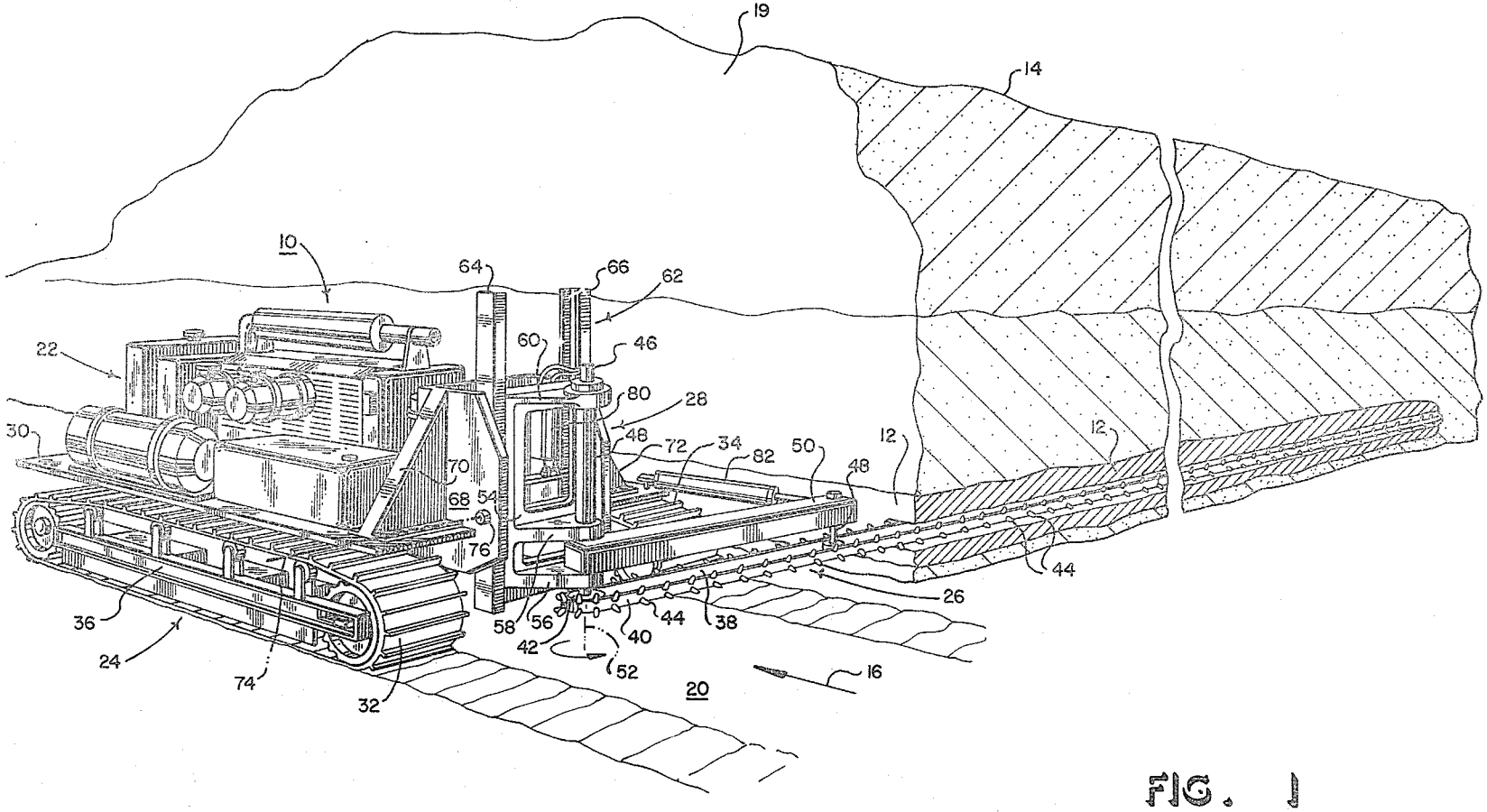
FIG. 1 is a perspective view of the coal mining apparatus of the present invention in operation with the overburden partially cut away to reveal an elongated cutter assembly engaged in cutting relation with a narrow seam, shallow coal deposit.

In the description which follows, like parts are marked throughout the specification and drawing with the same reference numerals, respectively. The drawing figures are not necessarily to scale and in certain instances portions have been exaggerated in order to more clearly depict certain features of the invention.

Referring now to FIG. 1, a coal mining machine 10 is shown in a strip mine removing a narrow seam shallow coal deposit 12 with minimum disruption of overburden 14. The mining machine 10 is shown moving along a line of travel 16 over an excavated surface 18 adjoining the vertically exposed face 19 of overburden 14 and coal deposit seam 12. The exposure of a horizontal narrow seam of coal at a shallow elevation commonly occurs in strip mining operations in which the removal of overburden is carried out over known areas of large concentrations of coal. The laterally extending horizontal coal deposits 12 may interconnect disjointed strip pits, or may lie contiguous to concentrated coal deposits. The mining machine 10 is shown traversing the floor 20 formed during excavation operations carried out in conventional strip mining procedures.

The principal components of the mining machine 10 are a power plant 22, a wide track crawler assembly 24, a cutter assembly 26 and an elevator assembly 28 on which the cutter assembly 26 is adjustable in elevation, pitch and sweep with respect to the coal deposit seam 12.

The principal components of the mining machine 10 are supported on a chassis 30 which preferably comprises a weldment of high strength steel. The wide track crawler assembly 24 comprises a pair of standard crawler tracks 32, 34 mounted for rotation on an undercarriage assembly 36 disposed beneath the chassis 30. A drive system (not shown) is coupled intermediate the power plant 22 and the crawler tracks which permits low speed, precisely controlled rates of crawl.

The power plant 22 preferably comprises an internal combustion engine 38 which is naturally asperated. A suitable engine is a GM 4-71 Detroit Deisel Unit which will develop 140 horsepower at 2100 RPM and 385 foot pounds of torque. A pair of axial piston hydraulic pumps (not shown) are coupled to the drive shaft of the power plant 22 for supplying hydraulic propulsion for the crawler tracks and for operation of the cutter assembly 26.

The mining machine 10 is propelled hydraulically by an axial piston variable displacement pump which drives two displacement axial piston hydraulic motors. The hydraulic pump is preferably a Sundstrand "22" series hydrostatic transmission that delivers a maximum of three cubic inches of transmission oil per revolution at 5000 psi. This system delivers 2200 inch pounds of torque at 500 psi, and a total of 18 gallons of oil at 1800 rpm. When divided evenly between the two hydraulic motors, a motor speed of approximately 850 rpm offers a maximum track speed of 28.5 rpm or 204.5 feet per minute resulting in 2.3 miles per hour, and torque at the track edge of 7700 foot pounds, assuming a 30:1 gear reduction.

The cutter assembly comprises an elongated cutter bar 38 and a cutting chain 40 engaged with a drive sprocket 42 which propells it around the periphery of the cutter bar. The cutter 38 is preferably heavy duty steel plate construction with movable portions (not shown) built in for controlling proper chain tension.

A number of teeth 44 are mounted in holders carried by the chain which maintain the teeth in proper cutting position and angle for maximum cutting efficiency. The teeth 44 are machined from a high strength material such as alloy steel and preferably have a carbide tip or point insert. The teeth 44 are mounted for rotation within their holders thereby providing self-sharpening action. The chain is preferably of the heavy duty excavating variety having a rating exceeding 225,000 pounds average ultimate strength. According to a preferred embodiment of the cutter assembly, the cutter bar has a total length of 30 feet with a usable boom length of 24 feet, and a boom cutting width of 12 inches to 24 inches depending upon the type of chain and tooth size.

The cutting chain 40 is driven hydraulically by a fixed displacement hydraulic motor 46 which drives the mining chain up to a maximum linear speed of 400 feet per minute. Hydraulic power to operate the motor 46 is provided by an axial piston variable displacement pump having a six cubic inch displacement which eliminates the need for a prohibitively large gear reducer. In order to obtain the chain speed of 400 feet per minute, both a hydraulic reduction and gear reduction are employed. Preferred equipment for this function is a Sunstrand "22" series pump and a Sundstrand "24" series motor, giving a motor speed of 900 rpm and a torque of 4400 inch pounds. By utilizing a gear reduction of 30:1, a chain speed of 452 feet per minute and torque at the edge of the cutting tooth of 99,000 foot pounds are obtained.

The cutting chain 40 is coupled to the hydraulic drive pump 46 through the sprocket 42 and a drive shaft 48. The cutter bar 38 is preferably supported at two widely spaced points by means of the drive sprocket 42 and a support pin 48. The support pin 48 is mounted for pivotal movement on a support boom 50 which extends in parallel, aligned relation with the cutter bar 38. The cutting chain 40 is secured for travel around the periphery of the cutter bar by conventional chain fasteners constructed of high strength alloy steel.

Figure 2:
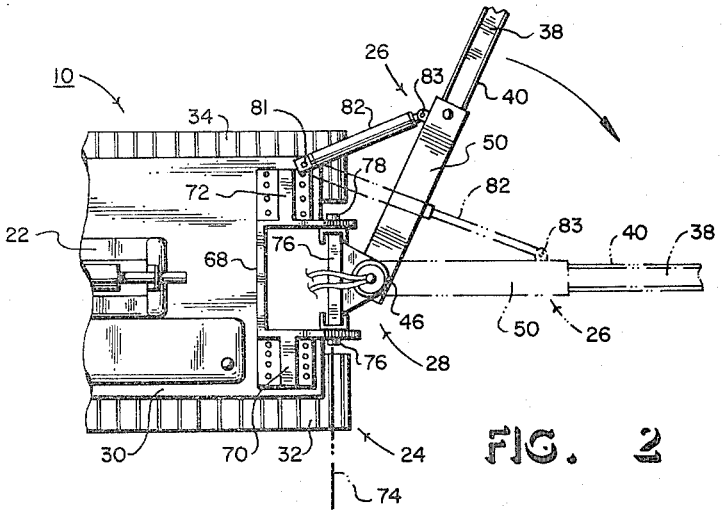
FIG. 2 is a plan view of a portion of the coal mining apparatus of FIG. 1 in which the sweeping range of a cutter assembly is illustrated.
Figure 3:
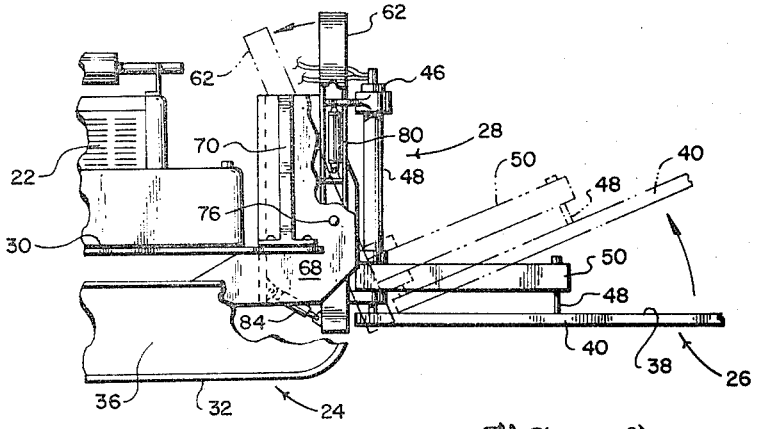
FIG. 3 is a right elevation view of a portion of the coal mining apparatus of FIG. 1 which illustrates the pitch range of the cutter assembly.
Figure 4:
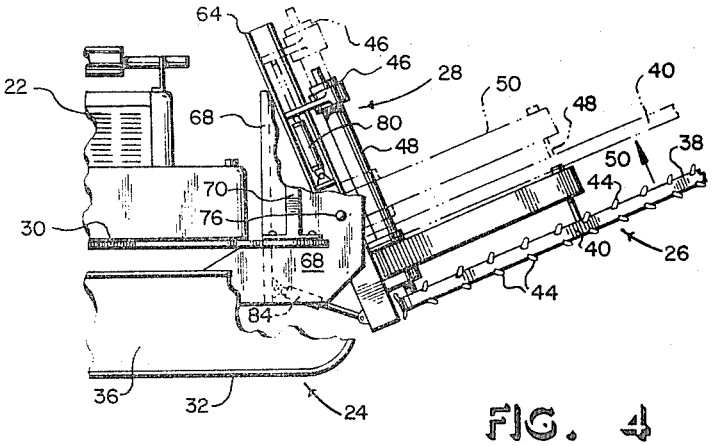
FIG. 4 is a side elevation view of the coal mining apparatus of FIG. 1 which illustrates the elevation range of the cutter assembly.

Referring now to FIGS. 2, 3 and 4, the cutter assembly is supported for movement in elevation, pitch and sweep with respect to the mining machine by means of the elevator assembly 28. The cutter bar 38 and support boom 50 are mounted for pivotal movement in azimuth (sweep) with respect to the axis of rotation 52 of the drive sprocket 42. The drive sprocket 42 and support boom 50 are connected at one end to an elevator block 54. The support boom 50 is confined for sweeping movement between gusset plate portions 56, 58 which project from the elevator block 54. The drive shaft 48 is journaled for rotation intermediate an upper gusset plate 60 and the lower gusset plates 56, 58. The hydraulic motor 46 is also supported by the upper gusset plate 60.

A guide track assembly 62 including guide rails 64, 66 is provided for guiding the elevator block 54 as it is displaced in elevation in order to adjust the working elevation of the cutter assembly 26. The guide rails 64, 66 are preferably channel members having a U cross-section. Ball bearing assemblies or roller bearing assemblies are disposed intermediate the laterally opposite sides of the elevator block 54 and the complementary channel portions of the guide rails 64, 66, respectively. The guide track assembly 62 is mounted for pivotal movement within a yoke weldment 68 which is supported on the chassis 30 by means of triangular gussets 70, 72 on opposite sides of the yoke. The guide track assembly 62 is movable about a pivotal axis 74 which extends horizontally and projects laterally with respect to the line of travel 16. The guide track assembly 62 is movably supported on the yoke weldment 68 on each side by means of pivot pins 76, 78. While the elevator block 54 and cutter assembly 26 may be displaced vertically through the guide rails of the guide track assembly 62, the combined assembly is rotatable about the horizontal pivot axis 74 to change the angle of pitch engagement of the cutter teeth 44.

The cutter assembly and elevator block are displaced vertically along the guide rails of the guide track assembly by means of a heavy duty, double acting linear hydraulic actuator 80 which is coupled intermediate the elevator block 54 and the guide track assembly 62 for displacing the elevator block through the guide rails 64, 66. This permits the working elevation of the cutter assembly to be adjusted giving it good ground clearance in the transport mode, and providing adjustment from ground level to approximately two feet above ground level during excavation.

According to another important feature of the invention, the horizontal sweep of the cutter assembly 26 is adjustable through a wide range to position the cutter assembly against the face of the seam 12 and to maintain the proper forces on the leading edge of the cutter assembly while operating. This is carried out by means of a heavy duty, double acting linear hydraulic actuator 82 which is coupled intermediate the chassis 30 and the support boom 50. The hydraulic actuator 82 is attached at each end of the chassis 30 and support boom 50, respectively, by universal pin and ball coupling connectors 81, 83 which permits angular displacement of the hydraulic actuator 82 with respect to either the chassis or the support boom while the cutter assembly is being raised or lowered in elevation. The cutter assembly is adjustable in sweep through a preferred range of approximately 70° as illustrated in FIG. 2.

To further accommodate changes in elevation and slope of the coal seam 12, the cutter assembly 26 is adjustable in pitch through a range of approximately 25° by operation of a heavy duty, double acting linear hydraulic actuator 84 which is pivotally coupled intermediate the guide track assembly 62 and the yoke weldment 68.

The linear hydraulic actuators 80, 82 and 84 are independently controllable to provide proper orientation of the cutter assembly with respect to the coal deposit seam 12 as the mining machine 10 traverses the exposed face 19. The hydraulic actuators also maintain the proper forces on the cutter chain as it excavates coal from the seam 12. Additionally, the same hydraulic actuators maintain the cutter bar 38 in a fixed position for transportation when not in use.

An operator station may be provided on the chassis 30 according to conventional arrangements. However, because of the relatively low working elevation of the line of engagement for the cutter assembly, it may be desirable in some instances to provide remote control for the mining machine 10 by means of which an operator following behind the machine can manipulate the elevation pitch and sweep of the cutter assembly 26 more easily.

Figure 5:
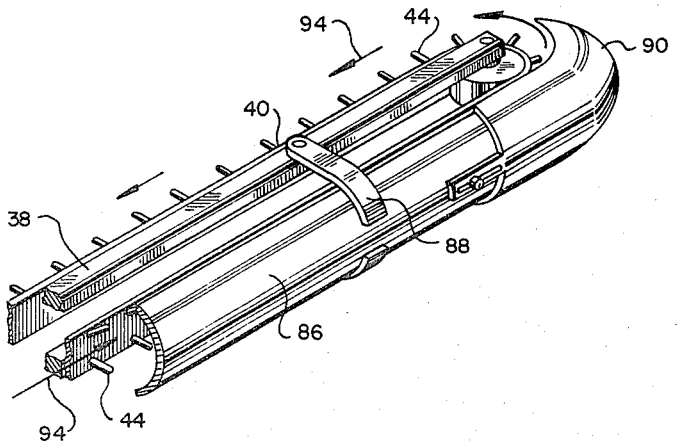
FIG. 5 is a perspective view of a portion of the cutter assembly including a crumber attachment.

Referring now to FIG. 5, the cutter assembly 26 preferably includes a crumber shield assembly 86 mounted to the cutter bar 38 by stand off support members 88. The crumber shield 86 extends along the length of the cutter bar and includes a curved end portion 90 which partially encircles the sprocket and cutting chain on the extreme end of the cutter bar. The crumber shield 86 is preferably concave and is spaced with respect to the cutting chain at a suitable distance to permit free movement of the cutting chain and also to permit the unrestricted flow of chunks of coal or other matter comminuted by the teeth of the cutting chain. The comminuted portions of coal are swept along the length of the crumber shield and are discharged to form a windrow 92 behind the mining machine 10. The path followed by the moving cutting chain 40 and portions of comminuted coal is indicated by the arrows 94. The curved end portion 90 of the crumber shield 86 is preferably free floating and automatically adjustable to the slot depth to keep the slot clean and crumbs to a minimum.

Figure 6:
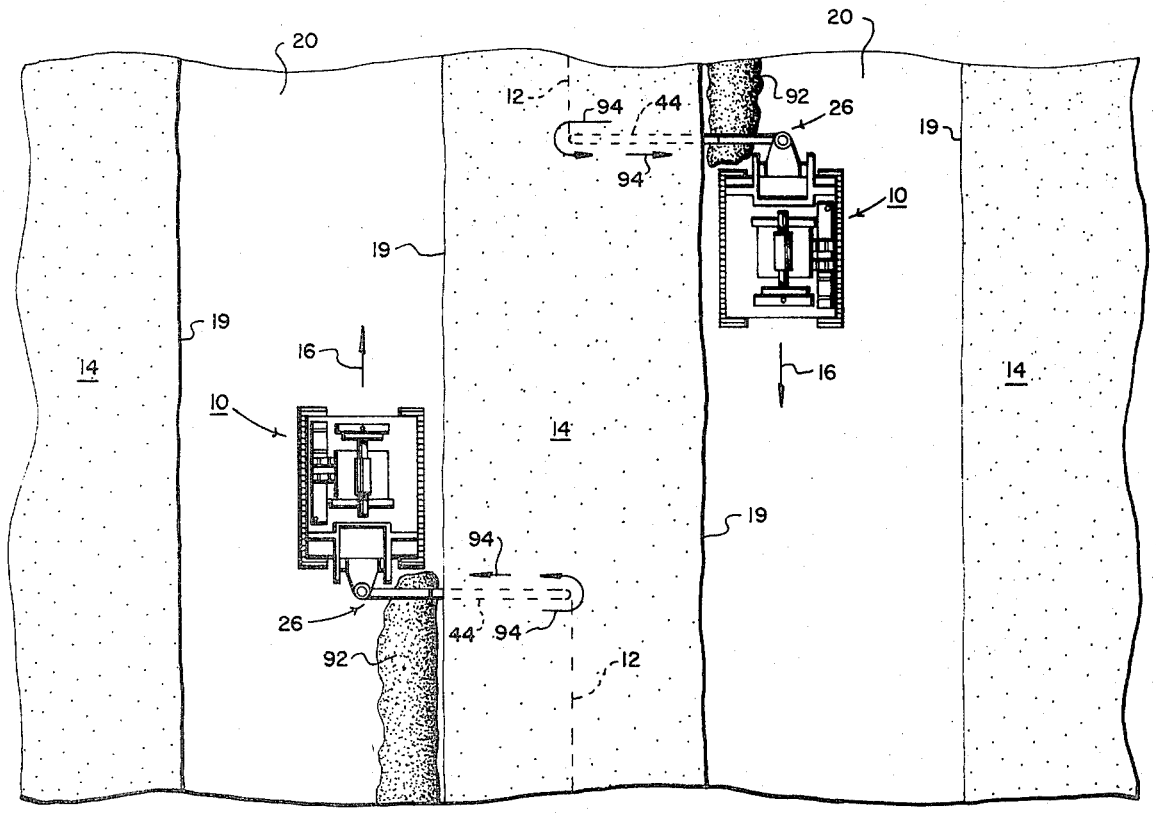
FIG. 6 is a plan view of a strip mining operation which illustrates the method of the invention.

A preferred method of operating the mining machine 10 is illustrated in FIG. 6. A conventional bucket machine or drag line (not shown) is employed to remove overburden from parallel strips 20 with the overburden being deposited on intermediate strips 14. The coal lying in the excavated strips 20 is removed in the conventional manner by the large bucket machines or drag lines. After this operation, the horizontal mining machine 10 of the present invention is utilized to recover the coal in the laterally extending seam 12 beneath the overburden in the intermediate strip 14. The excavated strips 20 are preferably spaced at approximately twice the lateral reach of the cutter assembly. The effective cutting length of a cutter assembly having a 30 foot cutter bar is approximately 24 feet so that the width of the intermediate overburden strips 14 should be approximately 48 feet. With this arrangement, substantially all of the coal lying in the seam 12 beneath the overburden in the intermediate strip can be removed by single passes of the mining machine 10 on either side of the intermediate strip. After the windrows 92 have been removed from the pits 20, the overburden lying on the intermediate strips 14 is used to fill and level the pits 20.

From the foregoing description of a preferred embodiment it will be understood that the present invention provides many advantages over present mining practices. By using the mining machine of the present invention, coal deposits from relatively narrow seams lying at shallow elevations can be economically recovered without removal of overburden and without disturbing the top soil. Because of the adjustability of the elevation, pitch and sweep of the cutter assembly, a deep slot having a large depth to thickness ratio can be cut throughout a shallow seam even though it may be slightly sloping or be characterized by undulations. Thus the coal production from a given strip mining operation can be substantially increased without significant overburden disturbance and with a relatively small capital investment.

Although a preferred embodiment of the present invention has been illustrated in the accompanying drawings and described in the foregoing detailed description, it will be understood that the invention is not limited to the embodiments disclosed, but is capable of numerous rearrangements, modifications and substitutions of parts and elements without departing from the spirit and scope of the invention as defined by the appended claims.

What is claimed is:

1. A mining machine for removing near surface mineral deposits comprising, in combination:

a mobile, wide track surface vehicle having a chassis and a power plant mounted on said chassis;

an elevator assembly including a guide track mounted on said chassis for pivotal movement about a horizontal axis extending transverse to the direction of travel of said vehicle and an elevator block engaged for reciprocal movement along said track;

a first linear actuator coupled intermediate said guide track and said chassis for angularly displacing said track about its pivotal axis;

a second linear actuator coupled intermediate said guide track and said elevator block for displacing said elevator block along said guide track;

a cutter assembly including an elongated guide bar and a cutting chain mounted for movement around the periphery of said guide bar, said guide bar being coupled to said elevator block for pivotal movement through a cutting plane extending substantially normal to said guide track;

a third linear actuator coupled intermediate said chassis and said cutter bar for angularly displacing said cutter assembly through said cutting plane; and rotary drive apparatus coupled to said cutter assembly for driving said cutting chain around the periphery of said guide bar.

2. The mining machine as defined in claim 1 including a crumber shield coupled to the cutter assembly and extending along the effective cutting length of the cutting chain for gathering and deflecting comminuted mineral portions.

3. A method for recovering near surface mineral deposits from an earth formation comprising the steps:

(a) excavating strip pits on both sides of the earth formation;

(b) engaging the near surface mineral deposit on one side of the exposed earth formation with a cutting chain driven around a laterally projecting guide bar to produce comminuted minerals in a deep lateral slot having a large lateral depth to vertical thickness ratio while adjusting the elevation, pitch and sweep of the guide bar as necessary to follow mineral formation undulations;

(c) ejecting the comminuted minerals from the slot and depositing the minerals in a windrow along the length of the excavated strip pit as said guide bar traverses said slot;

(d) repeating steps (b) and (c) on the opposite side of the exposed earth formation;

(e) removing the comminuted minerals from the strip pits; and, (f) replacing the overburden material in the strip pits.

* * * * *